United States Patent [19]

Slater

[11] Patent Number: 5,076,087

[45] Date of Patent: Dec. 31, 1991

[54] MANUFACTURE OF METAL CAN BODIES

[75] Inventor: David G. Slater, East Grinstead, United Kingdom

[73] Assignee: CMB Foodcan PLC, Worcester, United Kingdom

[21] Appl. No.: 462,223

[22] Filed: Jan. 9, 1990

[30] Foreign Application Priority Data

Jan. 9, 1989 [GB] United Kingdom ..... 8900391

[51] Int. Cl.[5] ..... B21D 19/06

[52] U.S. Cl. ..... 72/105; 72/94; 72/110

[58] Field of Search ..... 72/94, 105, 106, 110, 72/121, 124

[56] References Cited

U.S. PATENT DOCUMENTS

| | | | |
|---|---|---|---|
| 1,912,258 | 5/1933 | Coyle | 72/121 |
| 4,272,977 | 6/1981 | Gombas | 72/94 |
| 4,606,207 | 8/1986 | Slade . | |
| 4,760,725 | 8/1988 | Halasz | 72/94 |

FOREIGN PATENT DOCUMENTS

| | | | |
|---|---|---|---|
| 1210977 | 3/1960 | France | 72/105 |
| 583502A | 8/1981 | Japan . | |
| 255218 | 12/1985 | Japan | 72/105 |
| 256374 | 8/1926 | United Kingdom . | |
| 547229 | 8/1942 | United Kingdom . | |
| 1220129 | 1/1971 | United Kingdom . | |
| 2067158B | 9/1983 | United Kingdom . | |

*Primary Examiner*—Lowell A. Larson

*Attorney, Agent, or Firm*—Christie, Parker & Hale

[57] ABSTRACT

In a method of forming at an open end of a can body an out-turned end flange and an adjoining inward bead, the free end of the can body is carried frictionally in an annular groove formed in a transverse end face of a rotating driving head. In a first stage, an inner support roll is placed inside the can body in contact with its inner surface at a position spaced axially from the driving head, and an outer work roll is progressively advanced against the outer surface of the can body adjacent the driving head so as to form the inward bead, and thereby gradually retract the open end of the can body within the groove. In a second stage, the inner roll is advanced to a can body stabilizing position, and the work roll is then advanced further so as to withdraw the open end of the can body from the groove and then to turn it radially outwards as the can body end advances eccentrically across the rotating end face of the driving head. During the formation of the end flange the inner roll is progressively advanced so as to maintain its can stabilizing action while the can body end progresses across the rotating end face of the driving head.

23 Claims, 8 Drawing Sheets

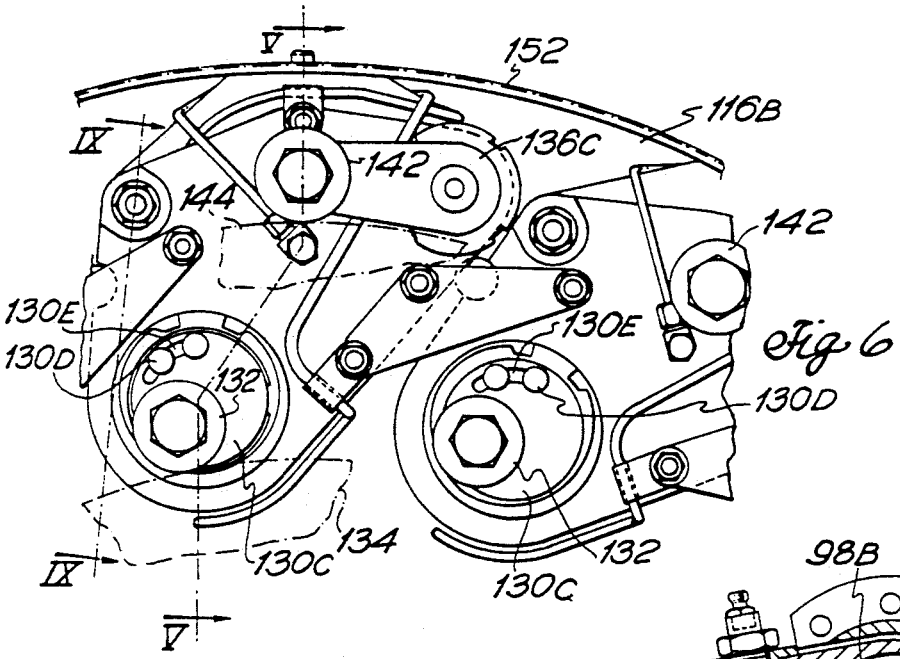
Fig. 6
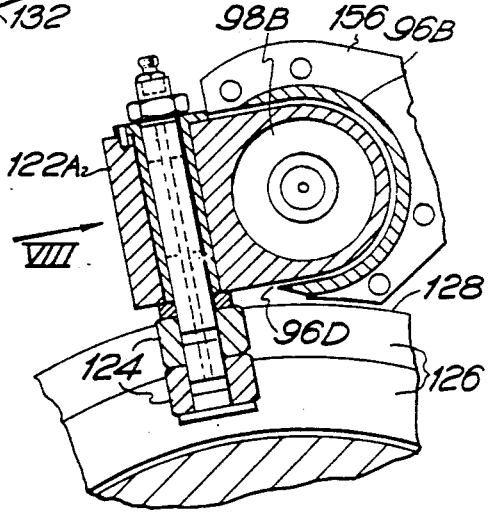
Fig. 7
Fig. 9
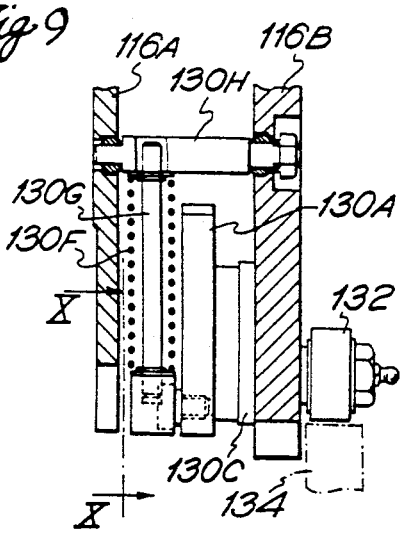
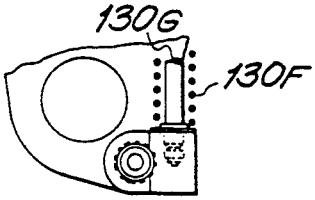
Fig. 10
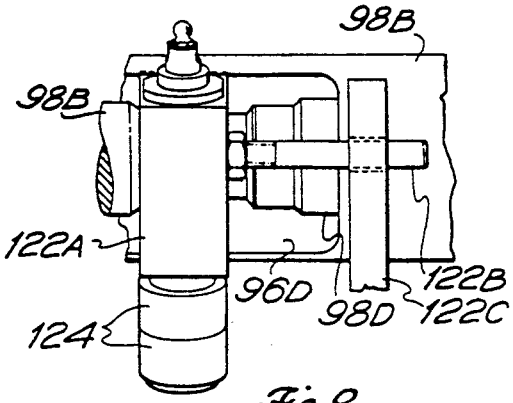
Fig. 8

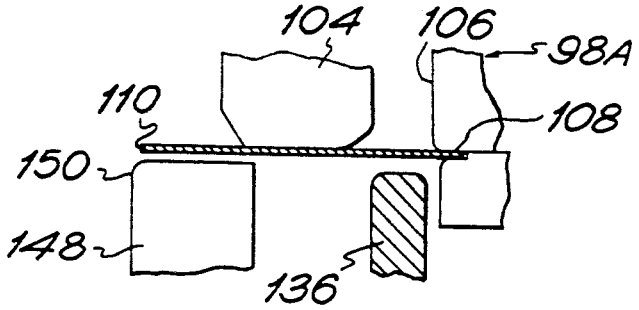
Fig 12 (i)
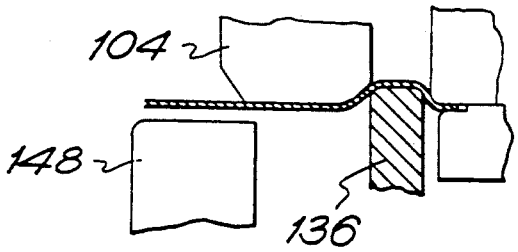
Fig. 12 (ii)
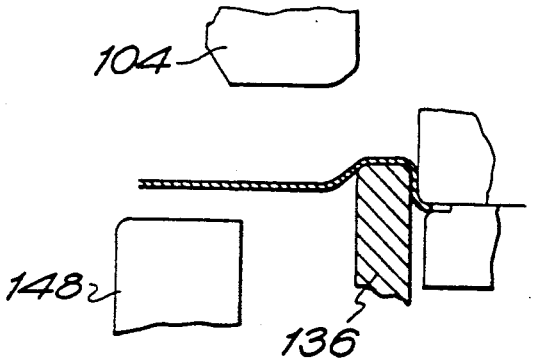
Fig. 12 (iii)
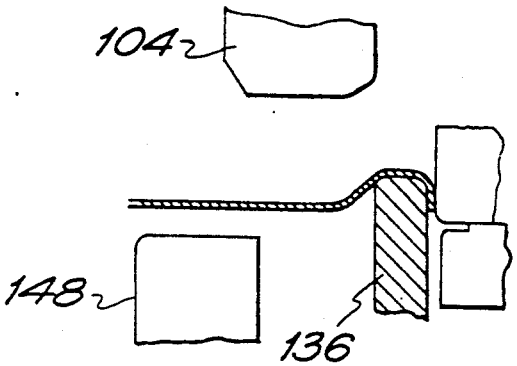
Fig. 12 (iv)

MANUFACTURE OF METAL CAN BODIES

This invention relates to the manufacture of metal can bodies, and more particularly to a method of and an apparatus for forming at the or each open end of a cylindrical can body wall an outwardly projecting end flange for receiving an end closure member, and preferably adjacent that flange an inwardly projecting bead thereby to provide a flange of outer diameter smaller than it would otherwise be, which flange is capable of being sealed to an end closure member of a diameter smaller than would otherwise be necessary.

A can body so formed thus exhibits at each such open end of its cylindrical wall a shoulder which leads into a neck of reduced diameter, which neck in turn leads into the out-turned flange. That flange may have a diameter which is less than, equal to, or greater than the diameter of the can body wall.

Such a can body wall may comprise a rectangular sheet metal blank which has been been folded upon itself and welded together along its adjoining longitudinal edges, the wall being arranged in that case to receive and be sealed by respective end closure members. Alternatively, such a cylindrical side wall may be formed at one end thereof with an integral end wall, and be arranged at its other, open end to receive and be sealed by an end closure member.

It is known in the prior art to form such a combination of shoulder, neck and flange in a can body wall by one of two methods, namely (a) metal spinning, which involves a thinning of the can wall as it is deformed, and so facilitates conservation of the overall height of the can body as the wall is deformed; and (b) metal beading, which involves no substantial alteration of the wall thickness. Thus, in this latter method, the overall height of the can body reduces as the beading process proceeds.

In the metal spinning process, an already tubular can body wall is supported on a mandrel having a surface profile which approximates to the desired internal surface of the finished shoulder, neck and flange, and an external work roll applies pressure radially to the can body and mandrel thereby to compress the can body wall onto the mandrel as the can body is rotated. As the external work roll is moved in an axial direction, continued radial roll pressure progressively generates the desired shoulder, neck and flange with appropriate thinning of the metal wall. Examples of such a process are described in patent specifications U.S. Pat. No. 3,688,538 (HOYNE) and U.S. Pat. No. 4,563,887 (BRESSAN). Though the thinning of the metal wall can be controlled to minimise the loss of height of the can body, this is accomplished only with the attendant risk of creating a work hardened neck.

Patent Specification U.S. Pat. No. 3,688,538 (HOYNE) discloses a metal-spinning apparatus in which the open end of a cylindrical metal can body 'B' is pre-flanged to render the open end "slightly outwardly flared". A driving head ("spinning ring or pilot 32") has a "shallow annular open V-shaped groove 34 which is formed with a frusto-conical wall 35 which is designed to snugly receive the body preflange P". The flared preflange is urged into that shallow groove, where its frictional contact with that wall 35 of the driving head serves to rotate the can body with the driving head. That shallow groove does not control nor restrict the movement of the free end of the preflange during the spinning of the bead adjacent that preflange.

In the metal beading process, a tubular can body is supported on an internal mandrel having annular surfaces shaped to receive and define the desired shoulder and neck portions of the can body, and an external work roll or rail surface cooperates with the internal mandrel to progressively urge the can body wall, passing between them, on to the profile defining surfaces of the mandrel. Examples of these beading machines are described in patent specifications GB 1,301,270, GB 1,356,462 and GB 1,534,716.

In GB 1,301,270 (METAL BOX), a welded cylindrical can body 13 already having an outwardly directed flange 19 is entered on to a mandrel 53 having a support surface 22, an arcuate shoulder-restraining annulus, and a cylindrical neck-restraining annulus defined by the mandrel body, and a flat faced flange-restraining annulus defined by a collar portion 64 surrounding the body and urged towards the body portions to define a groove around the mandrel. The mandrel is driven so as to rotate. Thus, as a can body carried on the mandrel is rotated, it rolls along an arcuate rail. That rail progressively applies a forming pressure to metal adjacent the can flange so as to create the shoulder and neck. This apparatus used dish-shaped spring washers to urge the flange-restraining surface of the collar 64 on to the flange 19 to accommodate the side seam weld thickness and create the finished flange. Such springs have a tendancy to weaken in the course of time and thus to cause incorrect flange angles, and eventually to break off and so stop production. A further problem arises during the setting up of the arcuate rail, to ensure that it delivers equal thrust on to all twelve mandrels of this multi-mandrel machine. Whilst fastidious machining and correct setting provided a machine that was operationally correct, uneven wear of any mandrel or its bearings could give rise to expensive remedial repair and consequent loss of production time.

Patent specification GB 1,356,462 (METAL BOX) sought to overcome these problems by the provision of (a) a mandrel that was expansible so as to internally grip and support the can body, and of (b) an external work roll to replace the rail. The work roll was mounted on an arm for movement towards and away from the mandrel. The expense of manufacture and maintenance of the expansible mandrel was significant. Though this apparatus was able to form a shoulder, neck and flange on an unflanged can body cylinder, as shown in FIG. 15, improved control of the final shape of the flange is highly desirable.

Patent specification U.S. Pat. No. 4,606,207 (SLADE/METAL BOX) discloses an arrangement in which a cylindrical can body is entered into a cylindrical groove which is defined on the one hand by a cylindrical wall portion of central mandrel, and on the other hand by surfaces which are formed within an encircling pressure sleeve and are constituted there by a flat annular end surface and an adjoining cylindrical surface. That pressure sleeve is said to travel in an axial direction as the length of the can body decreases and to prevent outward movement of the can body metal as an external roll applied to the can body forms thereon a shoulder, neck and flange.

According to one aspect of the present invention, there is provided a method of deforming an open end of a cylindrical metal wall constituting a can body to form therein an outwardly projecting end flange, which method comprises the steps of:

(a) placing the can body co-axially adjacent a rotatable driving head with the open end of said wall engaged frictionally and drivingly on a cylindrical portion of the driving head, which portion has a transverse end face;

(b) placing a rotatable outer roll adjacent the outer surface of the can body at a predetermined position lying axially adjacent the driving head;

(c) rotating the driving head about an axis normal to said end face thereby to rotate the can body about its longitudinal axis;

(d) progressively urging the outer roll radially against the outer surface of the can body as it is rotated, thereby to cause the progressive axial retraction and eventual withdrawal of the open end of the can body from said cylindrical portion thereby to deform said open end into an outwardly directed end flange; and (e) stabilising the position of the can body as it rotates about its own longitudinal axis whilst that axis of rotation is being displaced from the axis of rotation of the driving head by the displacement of said outer roll; said predetermined position of the outer roll being such as (i) to permit said progressive axial retraction and withdrawal of the open end of the can body wall from said cylindrical portion as the outer roll is displaced, (ii) to control the forming of the emerging end flange as said open end is displaced across and against said end face, and (iii) to maintain the driving connection between the can body and the driving head.

The method may also include the step of placing an inner roll inside the can body so as to make contact with the inner surface of the can body at a position which is (a) disposed axially adjacent the outer roll on the side thereof remote from the driving head, and (b) is displaced circumferentially from the outer roll in the direction of rotation of the can body, at which position the inner roll exercises a position-stabilising action on the can body when the can body is displaced from its central position on said end face of said driving head and moved across said end face by said outer roll.

Preferably, the inner roll is moved progressively further in the direction of rotation of the can body as the outer roll displaces the can body progressively across said end face, thereby to maintain the position-stabilising action of the inner roll on the can body.

The present invention also provides a method of deforming an open end of of a cylindrical metal wall constituting a can body thereby to form therein an outwardly projecting end flange and adjacent thereto an inwardly projecting bead, which method includes the steps of:

(a) placing the can body co-axially adjacent a rotatable driving head with the open end of said wall engaged frictionally and drivingly on a cylindrical portion of the driving head, which portion has a transverse end face and which portion is encircled by an outer annular portion which defines with said cylindrical portion an annular groove in which said open end of said can body wall is confined against radially outwards displacement;

(b) placing inside the can body at a predetermined axial distance from the driving head a rotatable inner roll of predetermined diameter less than the desired internal diameter of the bead to be formed in the can body;

(c) bringing that inner roll into contact with the internal surface of the can body thereby to support that surface against displacement;

(d) placing a rotatable outer roll adjacent the outer surface of the can body at a predetermined position lying axially within the distance separating the driving head and the inner roll and radially adjacent the inner roll;

(e) rotating the driving head about an axis normal to said end face thereby to rotate the can body about its longitudinal axis; and (f) progressively urging the outer roll radially against the outer surface of the can body as it is rotated thereby to cause the progressive formation in the can body wall of a bead and a consequential progressive axial retraction of the open end of the can body wall in the annular groove;

said annular groove being of radial width such as to maintain the shape of the open end of the can body wall substantially in its original cylindrical form so long as it remains engaged in the groove, and said predetermined position of the outer roll being such as to permit said progressive axial retraction of the open end of the can body wall in the annular groove as the bead is formed.

Preferably, after formation of the bead, the inner roll is moved from its position in contact with the inner surface of the can body wall and radially adjacent the outer roll to another position in the direction of rotation of the can body, in which position it exercises a position-stabilising action on the can body in the event that it is subsequently displaced from its central position on said end face and moved across said end face by said outer roll; and the outer roll is progressively urged further against the outer surface of the can body wall as it is rotated thereby to withdraw the open end of the can body wall completely from said annular groove and then to progressively urge that open end across and against said transverse end face thereby to deform said open end into an outwardly-directed flange lying adjacent the bead, said predetermined position of the outer roll being also such as (a) to control the forming of the emerging end flange, and (b) to maintain the driving connection between the can body and the driving head.

Preferably, the inner roll is moved progressively further in the direction of rotation of the can body as the outer roll displaces the can body progressively across said end face, thereby to maintain the position-stabilising action of the inner roll on the can body.

According to another aspect of the present invention, there is provided an apparatus for deforming a cylindrical can body wall to provide at the open end thereof an outwardly directed end flange, which apparatus comprises:

(a) a rotatable driving head having concentrically thereon a cylindrical portion for receiving in frictional and driving engagement therewith a said open end of a cylindrical can body wall, said cylindrical portion having a transverse end face;

(b) driving means for rotating the driving head about an axis normal to said transverse end face thereby to rotate a can body engaged with the driving head about a longitudinal axis of the can body;

(c) a rotatable outer roll for engaging the external surface of said can body wall engaged with said driving head;

(d) an outer roll carrier on which said outer roll is rotatably carried, said carrier being arranged for movement whereby to move said outer roll towards and away from said external surface of said can body wall as required;

(e) outer roll actuating means coupled to said outer roll carrier for effecting movement of said outer roll carrier as required so as thereby to urge said outer roll progressively into greater contact with said can body wall at a predetermined position axially adjacent said end face thereby to cause, on rotation of the driving head, the progressive axial retraction of the open end of the can body wall and the eventual withdrawal thereof from the cylindrical portion thereby to deform said open end into an outwardly directed end flange; and (f) stabilising means for stabilising the position of the can body as it rotates about its own longitudinal axis whilst that axis of rotation is being displaced from the axis of rotation of the driving head by displacement of the outer roll;

said predetermined position of the outer roll being such as (i) to permit said progressive axial retraction and withdrawal of the open end of the can body wall from said cylindrical portion as the outer roll is displaced, (ii) to control the forming of the emerging end flange as said open end is displaced across and against said end face, and (iii) to maintain the driving connection between the can body and the driving head.

The present invention also provides an apparatus for deforming a cylindrical can body wall to provide at the open end thereof an outwardly directed end flange and adjacent thereto an inwardly directed bead, which apparatus comprises:

(a) a rotatable driving head having concentrically thereon a cylindrical portion for receiving in frictional and driving engagement therewith a said open end of a cylindrical can body wall, said cylindrical portion having a transverse end face, and which portion is encircled by an outer annular portion which defines with said cylindrical portion an annular groove in which said open end of said can body wall is confined against radially outwards displacement;

(b) driving means for rotating the driving head about an axis normal to said transverse end face thereby to rotate a can body engaged with the driving head about a longitudinal axis of the can body;

(c) a rotatable inner roll for engaging the internal surface of a said can body engaged with said driving head, said inner roll having a predetermined outer diameter less than the desired internal diameter of the bead to be formed in the can body;

(d) an inner roll carrier on which said inner roll is rotatably carried, said carrier being arranged for movement to and from an operative position as required, in which position the inner roll contacts the internal surface of the can body engaged with said driving head, at a position spaced a predetermined axial distance from said driving head;

(e) a rotatable outer roll for engaging at a position radially adjacent said inner roll the external surface of said can body engaged with said driving head;

(f) an outer roll carrier on which said outer roll is rotatably carried, said carrier being arranged for movement whereby to move said outer roll towards and away from said external surface of said can body as required;

(g) inner roll actuating means coupled to said inner roll carrier for effecting movement of said inner roll carrier to and from said operative position as required;

(h) outer roll actuating means coupled to said outer roll carrier for effecting movement of said outer roll carrier as required so as thereby to urge said outer roll progressively into greater contact with said can body wall at a position lying axially within said distance separating said driving head and said inner roll, thereby to progressively form, on rotation of the driving head with said inner roll carrier in said operative position, an inwardly directed bead, said open end of said can body wall being retracted axially within but not withdrawn from said annular groove during the formation of the bead, and said groove being of a radial width such as to maintain the shape of the open end of the can body wall substantially in its original cylindrical form so long as it remains engaged in said annular groove.

In such apparatus, the movement of the outer roll carrier is preferably continued temporarily thereby to urge the outer roll further against the outer surface of the rotating can body wall and thereby (i) to withdraw the open end of the can body wall completely from said annular groove and then (ii) to progressively urge that open end across and against said transverse end face of the rotating driving head so as to deform said open end into an outwardly directed flange lying adjacent the bead.

The present invention also provides an apparatus for forming a shoulder, neck and flange on a cylindrical can body, which apparatus comprises a mandrel mounted for rotation on its axis and having peripheral surfaces to limit the shoulder and neck shape, a forming roll mounted for rotation about its axis, and means for moving the forming roll towards said peripheral surfaces of the mandrel thereby to progressively deform the wall into a shoulder, neck and flange, and which apparatus is also characterised in that: the mandrel is eccentrically supported in an end wall of an inner shaft, said mandrel having peripheral surfaces to define the shoulder and neck; the inner shaft is supported inside a driven sleeve, an end wall of which serves to limit the shape of the flange; and the end wall of the sleeve has a groove to receive the free edge of the can body to be formed; so that at a first position the periphery of the mandrel is adjacent the groove at which formation of the shoulder, neck and flange commences and thereafter rotation of the inner shaft within the sleeve moves the mandrel away from the groove to a second position at which the flange is finished between the forming roll and the end wall of the sleeve.

Other features of the present invention will appear from a reading of the description that follows hereafter, and from the claims appended at the end of that description.

One apparatus for, and a method of, deforming the open ends of cylindrical can body walls, and various modifications thereof, all according to the present invention, will now be described by way of example, and with reference to the accompanying diagrammatic drawings.

In those drawings:

FIG. 6 shows shows an end view looking on the right hand end of the mechanism shown in FIG. 5;

FIG. 7 shows a scrap sectional view of a cam follower for reciprocating a driving head of the mechanism shown in FIG. 5, as taken on the section VII—VII shown in FIG. 5;

FIG. 8 shows a scrap view looking in the direction of the arrow VIII shown in FIG. 7;

FIG. 9 shows a scrap sectional view taken on the section IX—IX shown in FIG. 6;

FIG. 10 shows a scrap view looking on the section X—X shown in FIG. 9;

FIG. 12 shows diagrammatically at (i) to (iv) various scrap radial sectional views showing the configurations of the principal can end forming parts of one forming mechanism at various stages in a can forming sequence;

Figure 1A:
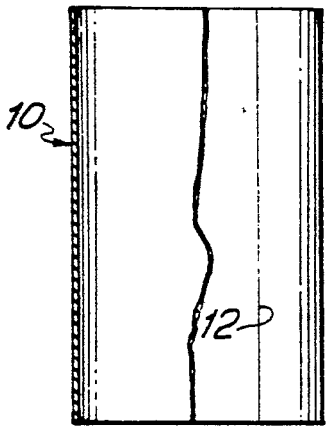
FIG. 1 shows part-sectional elevations of (a) a plain cylindrical can body wall, (b) such a plain cylindrical can body having its respective open ends deformed by an apparatus and method according to the present invention, and (c) an alternative form of cylindrical can body having its sole open end deformed in the same manner as those of the can body of (b) above.
Figure 1B:
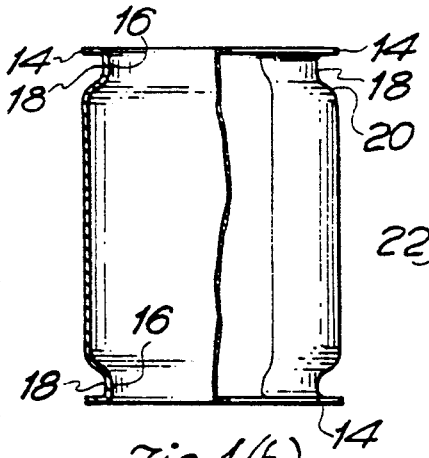
Figure 1C:
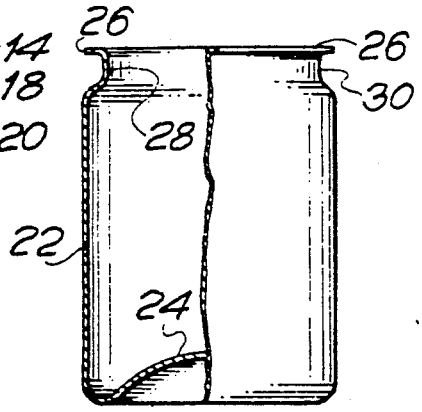

Referring now to FIG. 1, a cylindrical can body wall 10, for use in forming three-piece cans, is shown at (a) and comprises a rectangular sheet metal blank rolled into cylindrical form and having a longitudinal seam weld 12 securing its adjoining longitudinal edges together. The sheet metal blank is typically of 'tinplate', 'blackplate', or electro-chrome coated steel ('TFS'), of thickness in the range 0.15 mm to 0.17 mm, and of 'double-reduced temper'. For the purpose of securing end closure members (not shown) to the respective open ends of the can body wall, those open ends are first deformed to provide at each such open end an outwardly-directed end flange 14 and immediately adjacent the flange an inwardly-directed bead 16. The deformed can body thus exhibits externally at each end a neck 18 which is bounded on one side by the adjacent end flange 14, and on the other side by a shoulder 20 leading to the remaining cylindrical part of the can body wall.

An alternative form of can body, shown at (c), for use in forming a two-piece can, has a cylindrical side wall 22 having at one end thereof an integral end wall 24, and at the other, open end an outwardly-directed end flange 26 which adjoins an inwardly-directed bead 28 (and neck 30). Such a can body is produced initially by deep drawing a flat disc blank of a selected sheet metal (which metal may be one of those mentioned above, or else an aluminium alloy) to produce the cylindrical side wall 22 having an integral end wall 24.

The present apparatus and method are concerned with the deformation of the open ends of such cylindrical can body walls 10 and 22, to form said end flanges 14 and 26 and adjoining beads 16 and 28, and to do so without causing the cylindrical wall to wrinkle or buckle, and without producing any substantial work hardening of the metal of the end flange and adjoining bead.

Figure 2:
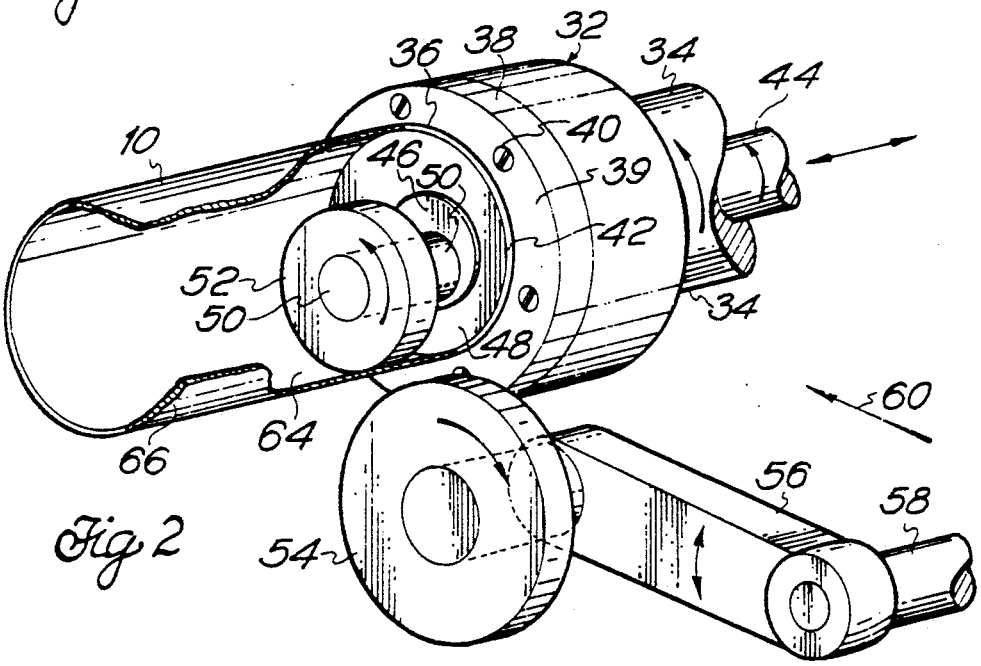
FIG. 2 shows a partly sectioned pictorial view of one can end forming mechanism for performing the method of the present invention.

Referring now to FIG. 2, the mechanism there shown comprises a rotatable driving head 32 having a driving shaft 34 which is carried in bearings (not shown) for both rotation and longitudinal movement. The driving head has a central spigot 36 around which an annulus 38 having an end face 39 is secured by screws 40. The annulus and spigot define between them a deep annular groove 42.

Carried co-axially within the driving head 32 is a carrier shaft 44 which is rotatable as required by an actuating means (not shown) whereby to alter its angular position within a predetermined limited range. An enlarged head 46 of the carrier shaft 44 protrudes slightly from the transverse end face 48 of the driving head 32. Secured eccentrically in the carrier head 46 is a short stub shaft 50 on which an inner, support roll 52 is rotatably mounted.

An outer, forming (or work) roll 54 is rotatably carried at the free end of a short lever arm 56, which is itself secured on and keyed to a torque shaft 58. That shaft lies parallel with the shafts 34 and 44, is carried in bearings not shown in the Figure, and is arranged for limited rotation by an actuating means (not shown) whereby to vary, in a predetermined manner, its angular position within a predetermined range.

As seen in side elevation (that is, in the direction of the arrow 60 in FIG. 2), the inner, support roll 52 is spaced a predetermined axial distance from the transverse end surface 48 of the driving head 32; and the outer, forming roll 54 lies positioned axially between the opposing transverse surfaces 62 (FIG. 3) and 48 of the inner roll 52 and the driving head 32, with axial clearances therefrom, as will appear from the later description.

In the FIG. 2, a cylindrical can body wall 10 (of the kind indicated at (a) in FIG. 1) is shown in position with one open end thereof frictionally and drivingly engaged in the annular groove 42, and with the inner, support roll 52 resting in contact with the internal surface 64 of the can body 10, and the outer, forming roll 54 positioned adjacent but not touching the outer surface 66 of the can body 10. The annular groove 42 has a radial width providing small clearance over the thickness of the can body wall, so as to facilitate entry of a can body into the groove. The axial depth of the groove is large in comparison with the radial width thereof. Since the can bodies to be deformed in this mechanism are never truly circular, their forced entry into the annular groove provides an interference fit in the groove, which fit is sufficient to drive the can body as the driving head is rotated.

Figure 3:
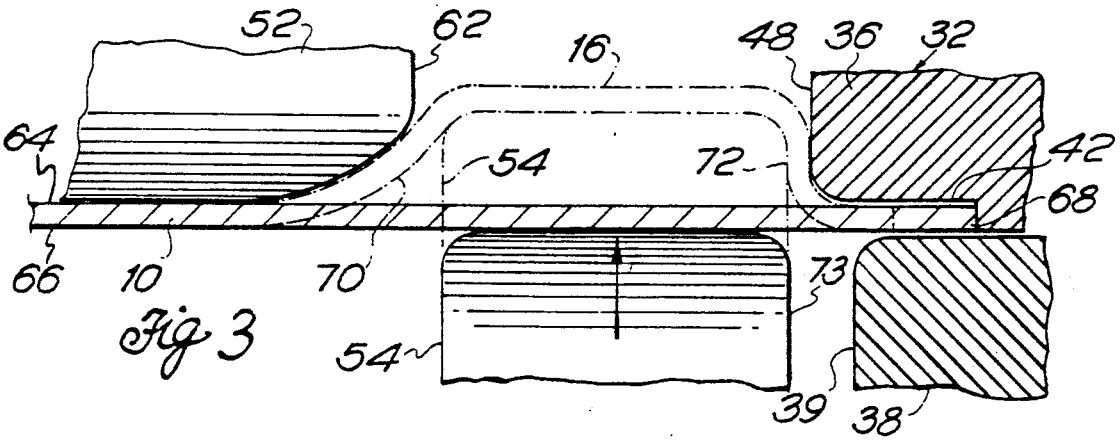
FIG. 3 shows a radial sectional view of the can end forming parts of the mechanism shown in FIG. 2, taken on a plane which includes the axis of rotation of a driving head incorporated in that mechanism.

The dispositions of the various working surfaces of the driving head 32 and the inner and outer rolls 52, 54 relative to the cylindrical wall 10 of a can body are illustrated in the FIG. 3, where both of the rolls are shown in contact with the respective inner and outer surfaces of the can body wall in readiness for forming the outwardly-directed end flange 14 and the adjoining inwardly-directed bead 16.

In preparation for the (de-)forming process, the carrier shaft 44 is held (by its actuating means) in its starting angular position, that is, with the stub shaft 50 and the inner roll 52 lying at the six o'clock position relative to the carrier shaft 44. With the driving head rotating at its operating speed (for example, 1500 RPM), a cylindrical can body 10 is fed (by infeed means not shown) into position with its right hand open end inserted fully and firmly into the annular groove 42, so that the can body then rotates with the driving head. In this condition, the inner roll 52 contacts the inner surface of the can body, and so is frictionally driven round by the can body.

The torque shaft 58 is then rotated slowly by its actuating means so as to raise the lever arm 56 and hence also the outer, forming roll 54. FIG. 3 shows the conditions prevailing at the moment the outer roll contacts the outer surface of the can body wall. In that condition, both of the inner and the outer rolls are rotated by the rotating can body.

Continued upward movement of the outer roll 54 causes the gradual inward displacement of the metal of the can body between the opposing surfaces 62 and 48 of the inner roll and driving head respectively, so as to form the desired inwardly-directed bead. The gradual formation of the bead causes the preferential drawing of metal from the annular groove 42, so that the open end of the can body is gradually retracted from that groove. The drawing of metal from the opposite side of the outer roll is resisted by the frictional resistance offered by the much greater contact surface area of the inner roll 52.

The upward movement of the outer roll is arrested to complete the formation of the inward bead before the free end or lip 68 of the can body becomes fully withdrawn from the annular groove 42. That condition is represented in the FIG. 3 by the chain-dotted lines, which show the final positions of the outer roll 54 and the metal forming the inward bead 16.

It will be appreciated that in gradually forming the inwardly-directed bead, the only parts of the can body metal that are subjected to additional hoop stresses (compressive in this case) are those forming the radial parts 70, 16, 72 of the bead. Whereas the parts of the metal actually withdrawn from the confinement of the annular groove 42 (so as to provide the right hand portion 72 of the bead) become so hoop-stressed, the parts of the metal lip 68 being retracted in the groove whilst still confined by the walls of the groove are not subjected to any such additional hoop stresses, since those parts are prevented from changing their shape. Any such additional hoop stresses can only be generated in that lip 68 once it has been forced to leave the confinement of the annular groove, and the sense of such additional hoop stresses will depend on whether the lip is caused to lie inside or outside the original diameter of the lip.

The process is now continued by rotating the carrier shaft 44 through ninety degrees in an anti-clockwise direction, as indicated in FIG. 2. This withdraws the inner roll 52 from its support position in contact with the inner surface of the can body wall, so that the can body is no longer supported against the upward pressure exerted thereon by the outer roll 54. Instead, the inner roll is positioned to restrain the can body against an off-centre whirling motion in the event that the can body is subsequently lifted upwards whilst still in driving contact with the rotating end face 48 of the driving head. Thus, in this new position the inner roll assumes a stabilising role, namely that of stabilising the can body at a position immediately above the outer roll as the can body rotates during the subsequent end flange forming part of the process, yet to be described.

The process is continued by further gradual upward displacement of the outer roll 54, thereby to further retract and finally withdraw the lip 68 of the can body from the annular groove 42. That lip thus becomes flattened against the rotating end surface 48 of the driving head by the adjacent rotating end surface 73 of the outer roll as that roll is lifted further. In order to maintain the can body fully stabilised during this part of the process, the inner roll 52 is progressively displaced further in the said anti-clockwise direction in a predetermined manner related to the progressive vertical displacement of the outer roll, in order to compensate for the upward movement of the rotating can body across, whilst pressed in sliding contact against, the rotating end surface 48 of the driving head.

The upward movement of the outer roll 54 is continued until the outwardly directed flange has been fully formed, and is subsequently terminated only when the can body has been raised by the outer roll through a further distance such as to position the can body in readiness for its withdrawal from the driving head and the consequent removal of the inner roll from the can body. Thereupon, the carrier shaft 44 is rotated still further in the anti-clockwise direction to bring the stub shaft 50 and inner roll 52 to the twelve o'clock position relative to the carrier shaft 44. In this condition, the inner roll 52 lies concentrically with the can body 10, and since the diameter of the inner roll 52 is less than the inner diameter of the beaded part 16 of the can body, the can body may be withdrawn from the driving head without contacting the inner roll.

Whereas in FIG. 2, the transverse end face 39 of the annulus 38 is shown stepped back from the plane of the end face 48 of the spigot 36, in other embodiments that end face 39 may be placed nearer, or even in the plane of, the plane containing the end face 48, the cylindrical groove in those cases being somewhat deeper than that shown in FIG. 2.

The same mechanism may be used to provide at the open end of a cylindrical can body 10 an outwardly-directed end flange 14 without an adjoining inwardly-directed bead. To do this, the outer annulus 38 is removed from the driving head. Then, after first positioning the can body 10 on the spigot 36 of the rotating driving head 32 as before, and setting the inner roll 52 to its three o'clock position where it is out of contact with the inner surface 64 of the can body 10, the outer roll 54 is raised firstly into contact with the outer surface 66 of the can body and then still further to the end of its flange-producing travel.

The progressive upwards movement of the outer roll 54, without any opposing resistance of the inner roll 52, causes the can body to move progressively upwards, thus drawing the open end of the can body progressively off the spigot 36 and pressing it against the end face 48 of the driving head 32, to form immediately the outwardly-directed end flange 14. As before, the inner roll 52 serves to stabilise the can body 10 during the flange forming process, and is likewise moved progressively in an anti-clockwise direction as the upwards displacement of the inner roll continues, so as to compensate for the upwards movement of the can body as it rotates in sliding contact with the rotating end face 48 of the driving head 32.

It should be noted that in the formation of an end flange 14 and an adjacent inward bead 16 by the method according to the present invention, none of the metal at the open end of a can body is highly stressed first in one sense (e.g. in tension), and then in the opposite sense in coming to its final shape. There is little, if any, tensile stress in the flange, most of the stressing there being in the hoop compressive mode. Hence, the risk of cracking the flange is reduced. In contrast, prior art methods described in the prior patent specifications referred to above cause the flange parts to be hoop stressed first in tension, and then in compression. Moreover, with the method of the present invention there is relatively little work hardening of the neck and flange parts of a finished can body. These two aspects are particularly important when working with thin, less ductile sheet metals, such as 'double reduced temper' steels.

It should also be noted that during the forming of the bead, the can body is simply and fully supported on either side of the outer, forming roll—by the inner, support roll on one side thereof, and by the driving head on the other side.

A further advantage of the method and mechanisms described above lies in that the presence of a local thickening of the can body wall at the longitudinal seam weld is handled without any difficulty, and without the need for special means for accommodating such local thickening.

Where a cylindrical can body 10 is to be formed with end flanges 14 and adjoining beads 16 at both ends to produce the can body shown in FIG. 1 at (b), it is advantageous to form both open ends simultaneously. For that purpose, a further mechanism similar to that shown in the FIG. 2 is arranged co-axially with and facing the mechanism of that Figure, so that a cylindrical can body may be placed between the two mechanisms. The two mechanisms are carried in linear bearings so that each may be advanced axially towards the other, after first introducing a can body 10 into the space between the respective inner rolls 52 of the two mechanisms, thereby to introduce the respective open ends of the can body into the respective annular grooves 42 of the respective driving heads 32. The respective driving heads have a common driving means coupled to their respective driving shafts 34, so that the can body is driven by each driving head at the same speed. The respective mechanisms may have respective individual actuating means for operating the respective carrier shafts 44 and the respective torque shafts 58. In such a case, the end flanges 14 and associated beads 16 may have the same configuration or different configurations at the respective ends of the can body.

Alternatively, the respective mechanisms may be provided with a common actuating means for operating the respective carrier shafts 44, and a common actuating means for operating the respective torque shafts 58. In that case, the configurations of the respective end flanges 14 and their respective associated inward beads 16 are the same at both ends of the can body.

It will be understood that the longitudinal cross sectional profile of an end flange 14 and an associated inward bead 16 produced by the methods and mechanisms described above is determined by the design of the tooling, that is by the design of (a) the shapes of the profiles of the respective inner and outer rolls 52, 54, (b) the axial spacings of those rolls relative to each other and to the end face 48 of the driving head 32, and (c) the respective actuating means for rotating the carrier shaft 44 and the torque shaft 58. It will also be understood that different configurations of end flange and associated inward bead may be produced by appropriate design of those roll profiles and axial spacings and of the respective actuating means.

In order to produce at a high rate can bodies formed with end flanges and associated inward beads by the above described method, several pairs of such opposed mechanisms may be arranged around the periphery of a turntable or turret in known manner, and be provided with a common driving means and synchronised infeed and outfeed devices for respectively supplying and removing cylindrical can bodies to and from the respective pairs of opposed mechanisms as those respective mechanism pairs are carried round by the turret past respective infeed and outfeed stations. One such multi-head turret machine embodying the present invention will now be described with reference to the FIGS. 4 to 14.

Figure 4:
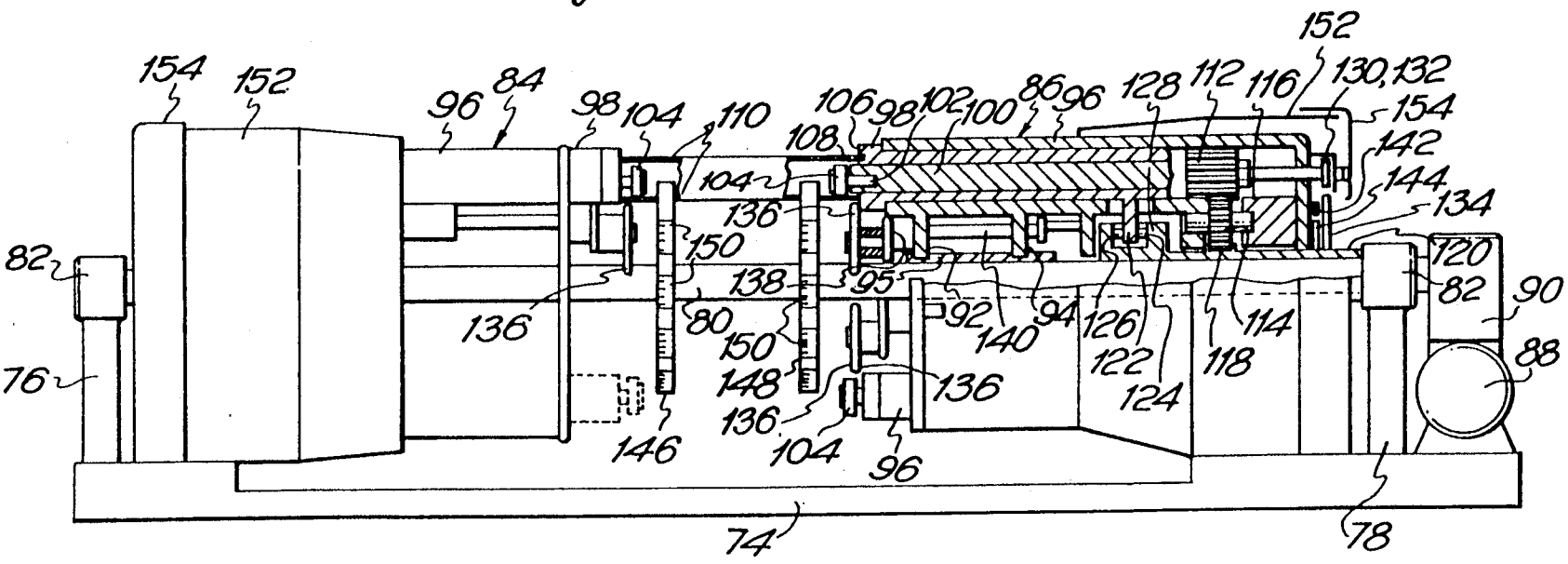
FIG. 4 shows a partly sectioned side view of a multi-head turret machine for practising the present invention, which machine incorporates a multiplicity of pairs of opposed can end forming mechanisms using the construction shown in FIG. 2.

Referring now to those Figures, the general arrangement of the machine is illustrated diagrammatically in the FIG. 4. The machine incorporates a baseplate 74 having axially spaced upright end members 76, 78. A central rotary shaft 80 mounted in respective bearings 82 carried in those end members carries two generally similar rotatable turret assemblies 84, 86, which assemblies are spaced axially apart, face one another, and are keyed to that shaft for rotation therewith. An electric driving motor 88 is coupled to that shaft through a speed-reducing gear unit 90.

Each turret assembly includes two axially-spaced, circular, transverse plates 92, 94 carried on a hub 95 which is keyed to the driving shaft 80. Those plates carry twelve fixed sleeves 96 spaced uniformly apart around a common pitch circle. Each such sleeve incorporates rotary and linear bearings (not shown) which house a 'driving head' 98, which is thus rotatable and axially reciprocable within the sleeve. Each such driving head is tubular and houses coaxially therein a rotary 'carrier shaft' 100 in the free end of which a 'stub shaft' 102 is eccentrically carried. The stub shaft carries concentrically a rotatable 'inner, support roll' 104.

The transverse end face 106 of each driving head incorporates an annular groove 108 in which is received, frictionally and drivingly, one end of a cylindrical can body 110. The opposite end of each driving head 98 is provided with an elongated driving gear pinion 112 which engages with a narrower, intermediate (idler) gear wheel 114, which is itself mounted in bearings carried on a backplate 116 of the turret assembly. The idler gear wheel 114 meshes inwardly with a larger, static, central gear wheel 118 which encircles the central drive shaft 80 and which is secured on a support sleeve 120 extending axially from the upright end member 78.

Each driving head is also provided with a transversely projecting cam follower shaft 122 which carries a cam follower wheel 124. That wheel projects into a continuous cam groove 126 formed in a static collar 128, which likewise surrounds the central shaft 80 and is carried on the support sleeve 120. The cam groove is shaped so as to axially reciprocate the cam follower wheel 124 engaged therein, and hence also the associated driving head, in a desired manner as the turret assemblies rotate.

The carrier shaft 100 extends through the backplate 116 and carries externally thereof a lever arm 130, at the end of which a cam follower wheel 132 is journalled for rotation. That follower wheel is spring biased into contact with the shaped periphery of a static cam disc 134, which is secured on the support sleeve 120.

An 'outer (or forming) roll' 136 is journalled at the end of a lever 138 which is itself carried on a 'torque shaft' 140. That shaft is journalled in the transverse plates 92, 94, and is coupled by linkage not shown with a cam follower wheel 142 which is spring biased into contact with the periphery of a second cam disc 144. That disc is mounted inboard of the first cam disc 134 on the support sleeve 120. Each such outer roll 136 is positioned axially between the transverse end face 106 of the associated driving head 98 and the associated inner roll 104.

Two 'star wheels' 146, 148 carried by the respective turret assemblies are spaced axially apart so as to provide for newly received can bodies temporary support at positions spaced axially from the respective adjacent inner rolls 104. Each such star wheel has respective can body receiving 'pockets' 150 aligned with the respective driving heads 98 of the turret assemblies.

Plain cylindrical can bodies 10 are received into the pockets 150 of the star wheels 146, 148 at an infeed position from the respective pockets of a conventional 'star wheel' infeed device (not shown), which is mounted on the baseplate 74 and is driven by the driving motor 88, the transition of the can bodies into the turret star wheels 146, 148 from the pockets of the infeed device being assisted by conventional external guide rails (not shown).

Likewise, can bodies are removed from the respective pockets 150 of the turret star wheels 146, 148 at an outfeed position into the pockets of a conventional 'star wheel' outfeed device (not shown), which is likewise mounted on the baseplate and is driven by the driving motor 88, the transition of the can bodies to the pockets of the outfeed device being assisted by conventional guide rails (not shown).

In operation, the central shaft 80, driven by the motor 88, carries with it the two turret assemblies 84, 86, typically at fifty revolutions per minute. That rotation results in the rotation of the respective idler gear wheels 114, by virtue of their enmeshment with the associated static gear wheels 118, and hence of the respective driving heads 98, typically at fifteen hundred revolutions per minute.

The cam groove 126 of each turret assembly is profiled in such a way that during each revolution of the assembly each driving head of the assembly in turn operates as follows—(a) is advanced from a retracted condition soon after passing through the infeed position and receiving there a plain cylindrical can body 110 (10), so as thereby to frictionally and drivingly engage the adjacent open end of the can body in the annular groove 108 of the driving head, (b) is maintained in that advanced condition whilst the turret assembly carries the driving head through the greater part of a revolution, during which time the open end of the can body is formed so as to provide thereon an inward bead 16 and an adjacent end flange 14, (c) is returned to the retracted condition just before reaching the outfeed position so as to move the driving head fully clear of the adjacent formed end of the can body in readiness for the removal of the formed can body by the outfeed device, and (d) is maintained in that retracted condition whilst a new can body is introduced by the infeed device into the turret star wheel pocket 150 aligned with the driving head.

The cam disc 134 of each turret assembly is profiled in such a manner as to cause the desired can end-forming sequence of movements of the carrier shaft 100 and associated inner roll 104 as the can end forming process (as described in the earlier part of this description) proceeds during that part of the turret assembly rotation which occurs between the introduction and removal of the can body into and from the associated star wheel pocket 150.

The cam disc 144 of each turret assembly is profiled in such a manner as to cause the desired can end-forming sequence of movements of the torque shaft 140 and the associated outer, forming roll 136 as the can end forming process (as described in the earlier part of this description) proceeds during that part of the turret assembly rotation which occurs between the introduction and removal of the can body into and from the associated star wheel pocket 150.

Whilst each driving head may typically make thirty revolutions during each revolution of the associated turret assembly, some thirteen of those driving head revolutions may be occupied with the formation of the inward bead, whilst some six of those driving head revolutions may be occupied with the formation of the end flange.

The upright end member 76 is secured on the baseplate 74 in a manner providing means of adjustment of the axial position of the left hand turret assembly 84 relative to the other turret assembly 86, thereby to facilitate the production of can bodies having different overall heights.

The design of the tooling, that is, of the inner and outer roll profiles and the axial spacing of those rolls and of the cams 126, 134, 144, may be the same for each of the turret assemblies, in which case the configuration of the end flange and associated inward bead is the same for both ends of the can body. Where the can bodies are to be used for the production of aerosol cans, the design of the tooling for the respective turret assemblies may be different, so as to provide different configurations of end flange and inward bead to suit the difference in the shapes of the 'cone' and 'dome' end closure members to be used at the upper and lower ends of the cylindrical can body.

Each turret assembly is encircled at its outboard end by a shroud 152 secured on the assembly for collecting lubricating oil which escapes from the gearwheels and bearings, and for directing it to a static end shroud 154 which is arranged to direct oil to an oil sump for recirculation.

Figure 5:
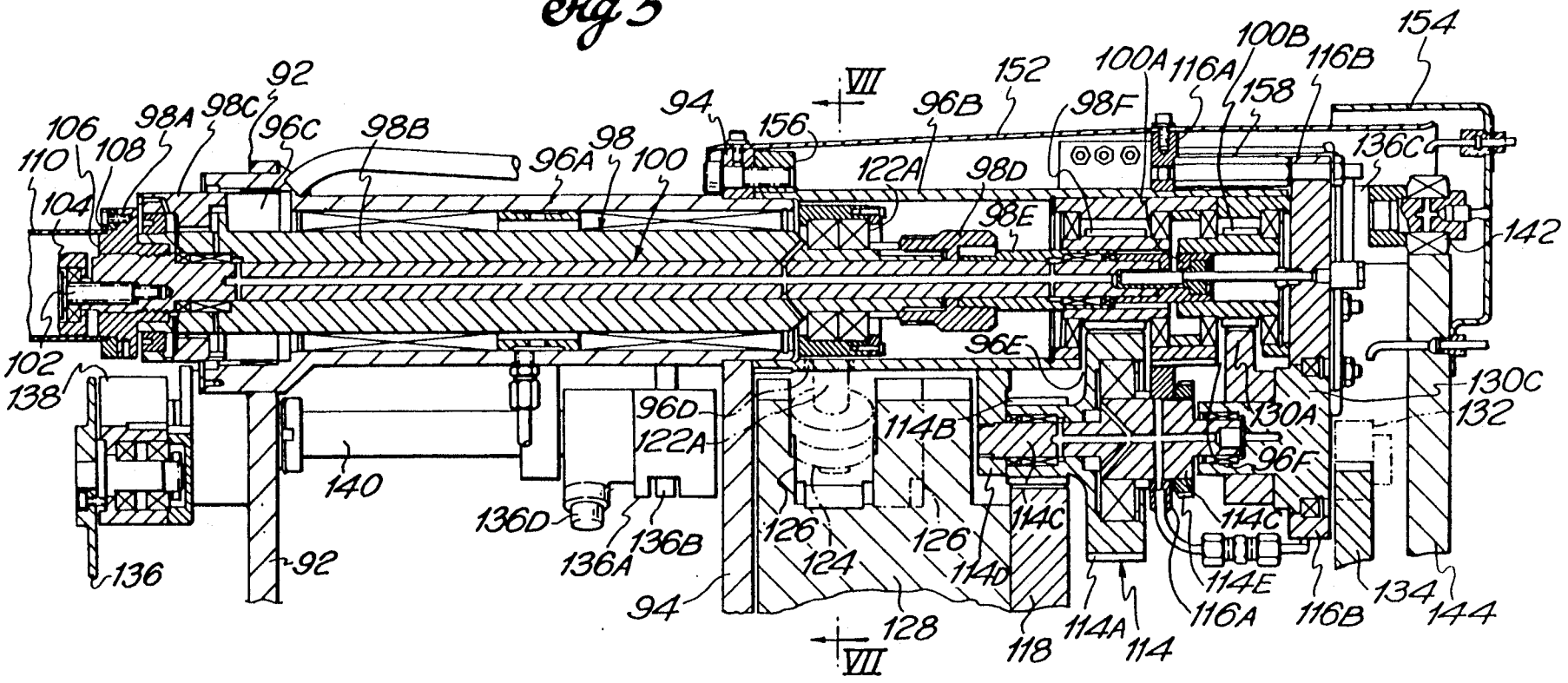
FIG. 5 shows to an enlarged scale a longitudinal section through one can end forming mechanism of the machine shown in FIG. 4.

The details of one practical version of the turret assemblies 84, 86 are shown in the longitudinal sectional view of FIG. 5, and the associated scrap sectional views shown in the FIGS. 6 to 10.

In those Figures, wherever appropriate, the respective parts bear reference numbers which are the same as those of the corresponding parts shown in FIG. 4. Where a component of FIG. 4 comprises a number of constituent parts in the FIGS. 6 to 10, those parts will be identified by an additional letter 'A,B,C . . . etc'. Only those parts which differ significantly from the detail of corresponding parts of FIG. 4 will be described below.

Various bearings for enabling rotation, and in some cases axial reciprocation, of various parts relative to supporting parts are indicated, by means of squares or rectangles having crossed diagonal lines. Likewise, various ducts and pipes for conveying lubricating oil to the various gears and moving parts are indicated. Since the configuration and purpose of such gears and ducts will be self-evident from the showing of the Figures, those bearings and ducts will not be specifically mentioned, nor given reference numbers, unless clarity of description requires otherwise.

In each turret assembly:

(a) the transverse plates 92, 94 are carried on a hub (not shown) which rides on and is keyed to the central shaft 80;

(b) each fixed sleeve 96 comprises a first tube 96A welded into the transverse plate 92, and a second tube 96B which is secured in an annulus 156 which is bolted to the transverse plate 94;

(c) a backplate assembly 116 comprises an inner backplate annulus 116A carried on and welded to the tubes 96B, and an outer backplate annulus 116B secured by spacing pillars 158 to the inner backplate annulus 116A;

(d) the driving head 98 comprises a head portion 98A secured at the end of a driving shaft 98B. That shaft carries adjacent the head portion 98A a load bearing collar 98C which is axially reciprocable in and out of a load bearing chamber 96C of the tube 96A;

(e) the driving shaft 98B carries on a reduced diameter part thereof a cam follower arm 122A which extends through a side opening 96D in the tube 96B, carries the cam follower wheel 124, and is restrained against rotation by a transverse pin 122B. That pin is axially slidable in a location post 122C carried on the side of the tube 96B as the driving shaft 98B reciprocates axially. The cam follower arm 122A is secured in position by a nut 98B which is secured on the end of the driving shaft 98B for rotation therewith;

(f) a tubular connector 98E is secured at one end thereof in the free end of the nut 98D, being keyed therein for rotation therewith. The other end of the connector 98E is externally of square transverse cross section, and is slidingly received in a correspondingly square shaped socket formed in a gear pinion 98F which is carried for rotation in bearings disposed in the tube 96B. By that means, the drive from the pinion 98F is transmitted to the driving shaft 98B regardless of the axial position of that driving shaft;

(g) the carrier shaft 100 extends through the driving shaft 98B, the nut 98D and the connector 98E, and carries bearings for supporting the encircling end of the tubular connector 98E. Those bearings are secured axially in position by a tail-piece 100A which is bolted to the end of the carrier shaft 100, and which has externally a square transverse cross section. That tail-piece is slidingly received in a correspondingly shaped socket formed in a gear pinion 100B which is likewise carried in the end of the tube 96B;

(h) a second opening 96E in the side of the tube 96B enables the pinion 98F to be engaged by the larger wheel 114A of a compound intermediate gear 114. The smaller wheel 114B of that compound gear 114 engages the static gear wheel 118. The compound gear is journalled for rotation on a fixed shaft 114C which is carried at one end in a bearing plate 114D secured on the side of the tube 96B, and at an intermediate position thereon in an aperture formed in the inner backplate 116A. That shaft is secured by a nut 114E which engages the inner backplate annulus 116A;

(i) a third opening 96F in the sleeve tube 96B enables the gear pinion 100B to be engaged by a quadrant gear 130A which is adjustably carried on a shaft 130B. That shaft is rotatably carried on the free end of the fixed shaft 114C and carries an integral disc 130C which is itself carried in bearings mounted in the outer backplate annulus 116B. The disc 130C carries outboard of the outer backplate annulus 116B the cam follower wheel 132, which wheel is positioned eccentrically on the disc 130C. The angular position of the quadrant gear 130A relative to the disc 130C is adjustable by virtue of fixing bolts 130D which pass through an arcuate slot 130E formed in the disc 130C and which are screwed into the quadrant gear 130A. The cam follower wheel 132 engages the periphery of the cam disc 134, being biased into contact therewith by a compression spring 130F which is carried on a spindle 130G mounted on the side of the quadrant gear 130A and which is trapped there by by a stop 130H mounted between the backplate annulii 116A and 116B; and (j) the torque shaft 140 carrying the lever 138 and the associated outer, forming roll 136 is journalled in the transverse plates 92, 94, and carries a further lever arm 136A which is coupled by an upwardly directed link 136B with a further transverse shaft (out of sight) carried in the transverse plate 94 and the backplate annulii 116A and 116B. That transverse shaft carries outboard of the outer backplate annulus 116B a further lever arm 136C, which carries at its free end the cam follower wheel 142. That wheel is biased into contact with the periphery of the cam disc 144 by a spring biasing device 136D which is coupled to the shaft 140 adjacent the transverse plate 94.

Figure 11:
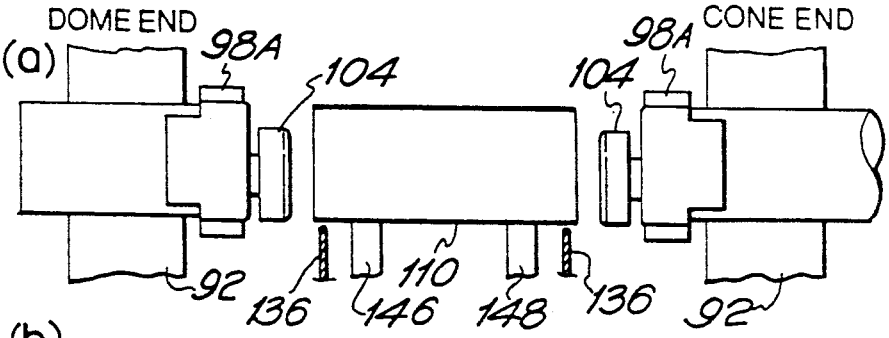
FIG. 11 shows diagrammatically at (a) to (f) various side views of the principal can end forming parts of one pair of associated can end forming mechanisms, indicating the configuration of those parts at various stages in a can forming sequence.
Figure 11:
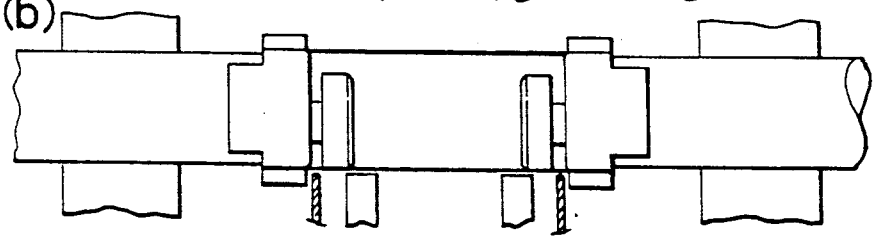
Figure 11:
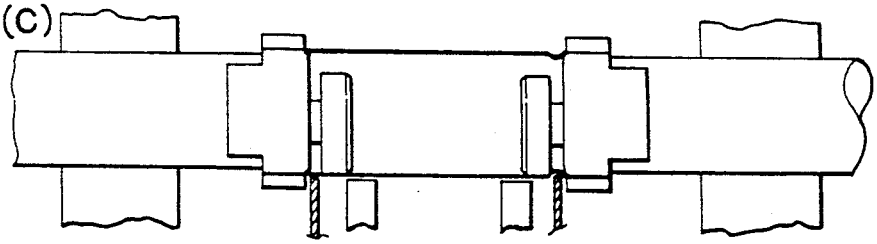
Figure 11:
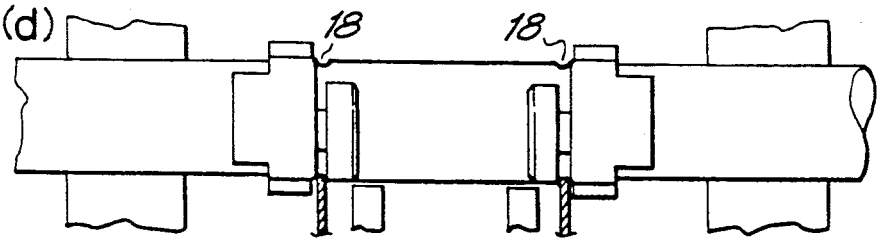
Figure 11:
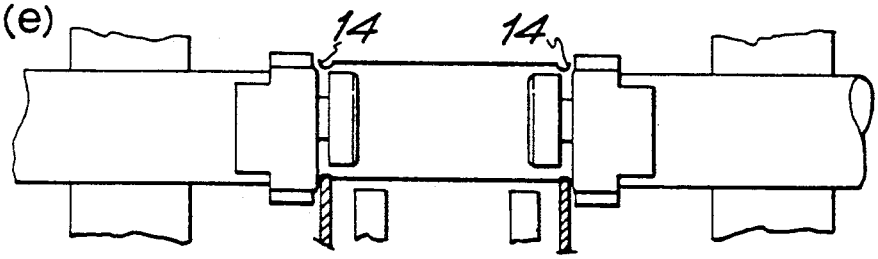
Figure 11:
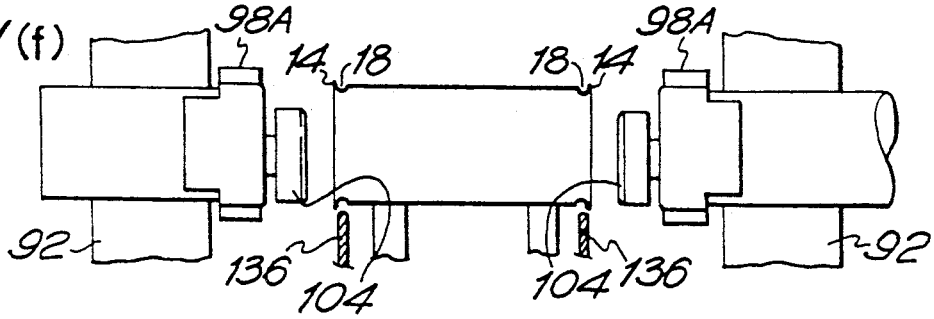
Figure 13A:
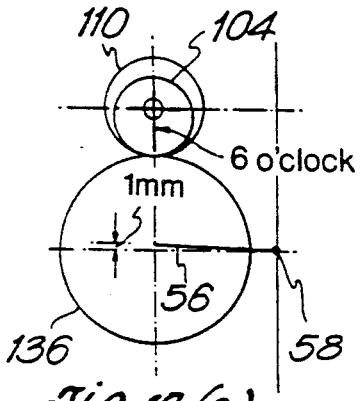
FIG. 13 shows diagrammatically at (a) to (g) various scrap end views showing the configurations of the principal can end forming parts of one forming mechanism at various stages in a can forming sequence.
Figure 13B:
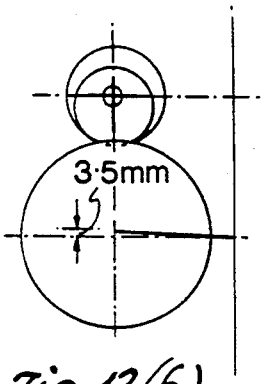
Figure 13C:
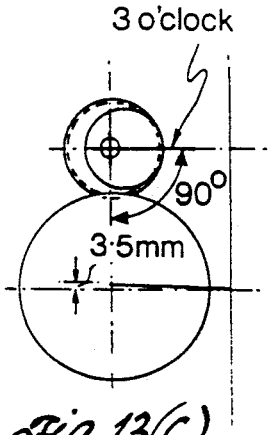
Figure 13D:
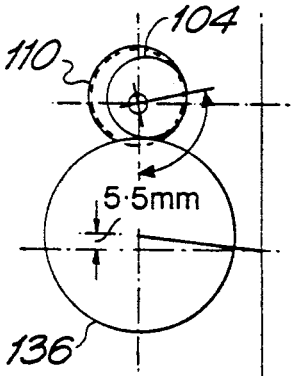
Figure 13E:
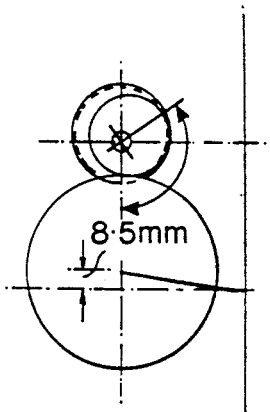
Figure 13F:
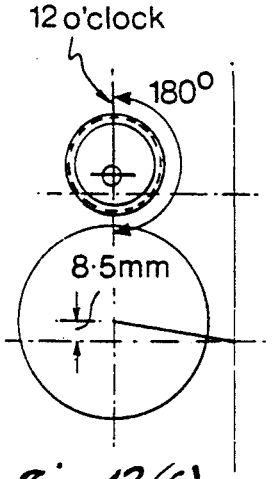
Figure 13G:
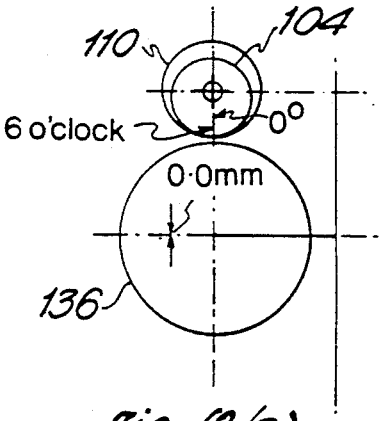

FIG. 11 shows diagrammatically at (a) to (f) various stages in the sequence of forming operations carried out by each pair of opposed driving heads and their associated inner and outer rolls during one revolution of the turret assemblies:

at (a), the driving heads are retracted, and a can body has just been placed in the pocket 150 of the turret star wheels 146, 148;

at (b), the driving heads have been advanced so as to engage the respective ends of the can body in the respective annular grooves of the respective driving heads and thereby lift the can body off the star wheel surfaces rotate it;

at (c), the outer (forming) rolls 136 have been raised so as to begin the forming of the inward beads 16 and corresponding necks 18;

at (d), the outer rolls have completed the formation of the beads 16;

at (e), the inner rolls have been rotated to their respective stabilising positions in which they no longer oppose the upward thrusts of the outer rolls, and the outer rolls have moved upwards to complete the formation of the respective flanges 14; and at (f), the forming process is complete, the driving heads have been retracted to allow the can body to rest on the star wheel surfaces to await removal by the outfeed device, and the inner rolls have been rotated back to their respective 'six o'clock' starting positions to await the arrival of the next can body.

In those diagrams, the left hand turret assembly is arranged to flange and bead (neck) the can body at that end in a manner suitable for receiving and securing thereon a dome (i.e. base) closure member of an aerosol, whereas the right hand turret assembly is arranged to flange and bead the can body in a manner suitable for receiving and securing thereon a cone (i.e. top) closure member of an aerosol.

FIG. 12 shows diagrammatically a series of enlarged views showing the configurations of the inner and outer rolls 104, 136 and their associated star wheel 148 and driving head 98 in relation to the can body wall at various stages. Stage (i) corresponds to the stage indicated in FIG. 11 at (*b*); stage (ii) corresponds to that indicated at FIG. 11 (*d*); stage (iii) corresponds to that indicated at FIG. 11 (*e*); and stage (iv) corresponds to a stage just prior to that indicated at FIG. 11 (*f*), i.e. just before the driving heads have been retracted.

FIG. 13 shows diagrammatically various end views, looking into a can body engaged on the right hand turret assembly 86, at various stages in the sequence of movements of the inner and outer rolls necessary for forming the flange and bead on the right hand end of a tinplate can body having the following nominal finished dimensions: internal diameter—52 mm; wall thickness—0.15 mm; internal diameter of the bead—47 mm; and end flange radial width of 2.5 mm:

at (a), the inner and outer rolls are both in contact with the can body ready for the forming process, the outer roll having already been displaced through a vertical distance of 1 mm following the engagement of the can body in the annular grooves of the respective driving heads;

at (b), the outer roll has been raised through a further vertical distance of 2.5 mm to form the bead 16, whilst the inner roll has remained at the 'six o'clock' position;

at (c), the inner roll has been displaced in an anticlockwise direction to its 'three o'clock' position, whilst the outer roll has remained temporarily stationary;

at (d), the outer roll has been displaced through a further vertical distance of 2 mm to begin the formation of the flange 14, whilst the inner roll has been gradually further displaced in an anti-clockwise direction, through approximately 11 degrees thereby to provide the necessary can position stabilising action;

at (e), the outer roll has been displaced through a further vertical distance of 3 mm to its maximum height (the formation of the flange then being complete, and the can body having been raised to the position in which it is ready for retraction of the driving heads and the withdrawal of the inner rolls from within the can body), whilst the inner roll has been gradually further displaced in an anti-clockwise direction, through approximately 10 degrees thereby to maintain the necessary stabilising action;

at (f), the outer roll has descended to its lowermost, biased position 1 mm below the position shown at (a), and the inner roll has been displaced further in an anticlockwise direction to the 'twelve o'clock' position in which it lies concentric with the finished can body, ready for the removal of the can body by the outfeed device; and at (g), the inner roll has returned in a clockwise direction to its starting position at '6 o'clock', whilst the outer roll has returned to its biased starting position, the rolls then being ready for the infeed of the next can body and the commencement of the next flanging and beading cycle.

Figure 14:
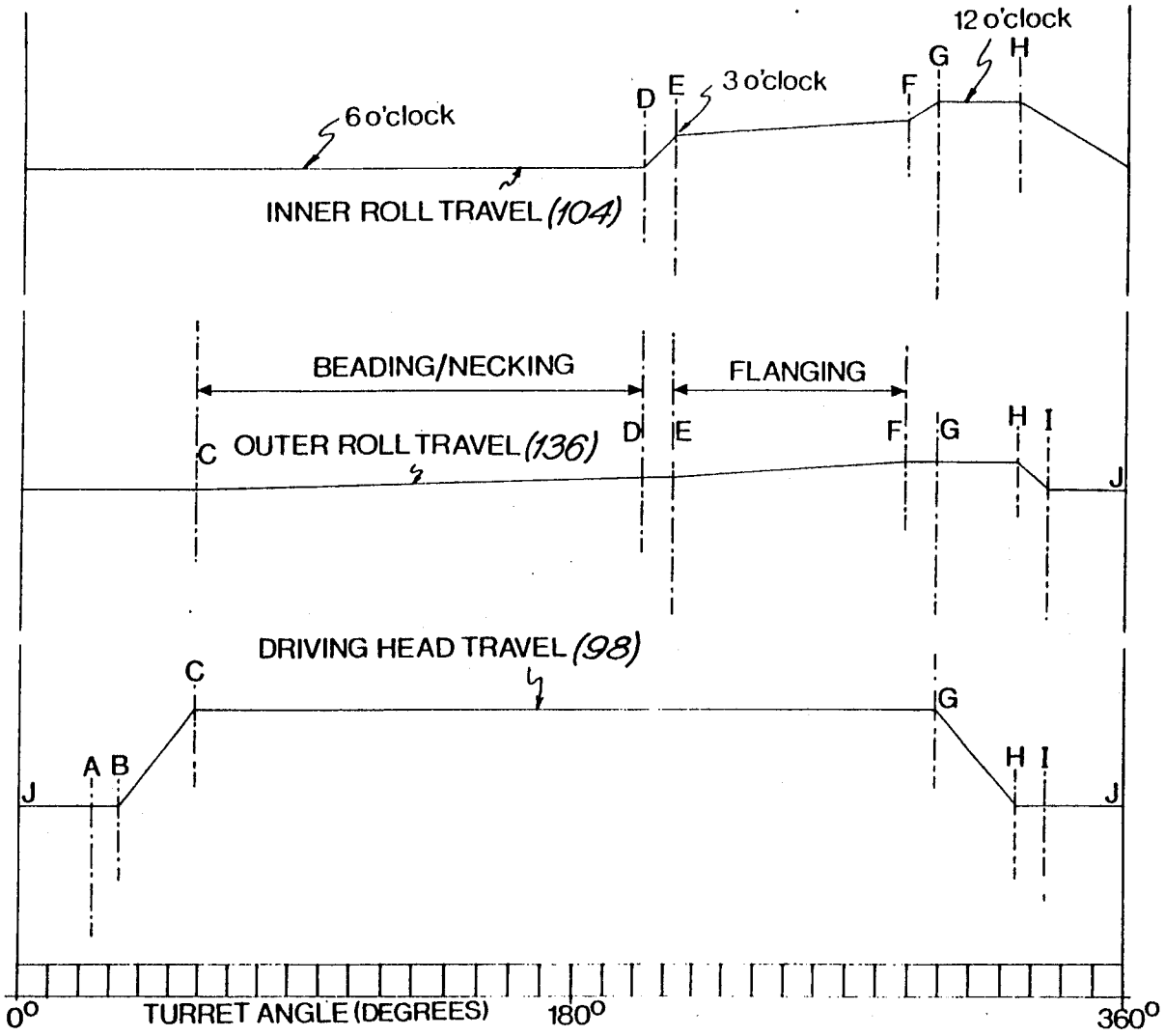
FIG. 14 shows at (a) to (c) various graphs showing the manners in which the various can end forming parts of one can end forming mechanism are displaced during one can end forming sequence.

FIG. 14 shows, to a base of turret angle (0°-360°), at (a), (b), and (c) graphs depicting the respective manners in which an inner roll and its associated outer roll and associated driving head move during one revolution of the turret assemblies. In those graphs, the following states are to be noted:

at (A), a can body is fed into the turret star wheel pocket 150 at the infeed position;

at (B), the driving head and associated inner and outer rolls have moved clear of the infeed device and the advance of the driving head commences;

at (C), the driving head is fully advanced and so drivingly grips and rotates the can body in readiness for formation of the bead 16;

at (D), the outer roll has advanced to the point where the formation of the bead is complete;

at (E), the inner roll has moved to the 'three o'clock' position, in readiness for the formation of the end flange 14;

at (F), the outer roll has moved to its maximum vertical position to complete the formation of the flange, with an attendant anti-clockwise displacement of the inner roll to approximately the 'two o'clock' position so as to provide stabilisation of the can body during flange formation;

at (G), the inner roll has moved to its 'twelve o'clock' position in readiness for the retraction of the driving head;

at (H), the driving head has completed its retraction and is hence clear of the can body, and the inner roll starts to move back to its 'six o'clock' starting position;

at (I), the outer roll has moved to its biased starting position clear of the can body, and the can body is removed from the star wheel pocket by the outfeed device; and at (J), the inner roll has returned to its starting position in readiness for the infeed of the next can body.

I claim:

1. A method of deforming an open end of a cylindrical metal wall constituting a can body to form therein an outwardly projecting end flange, which method comprises the steps of:

(a) placing the can body co-axially adjacent a rotatable driving head with the open end of said wall engaged frictionally and drivingly on a cylindrical portion of the driving head, which portion has a transverse end face;

(b) placing a rotatable outer roll adjacent the outer surface of the can body at a predetermined position lying axially adjacent the driving head;

(c) rotating the driving head about an axis normal to said end face thereby to rotate the can body about its longitudinal axis;

(d) progressively urging the outer roll radially against the outer surface of the can body as it is rotated, thereby to cause the progressive axial retraction and eventual withdrawal of the open end of the can body from said cylindrical portion thereby to deform said open end into an outwardly directed end flange; and (e) after withdrawal of the open end of the can body from said cylindrical portion, stabilising the position of the can body as it rotates about its own longitudinal axis whilst that axis of rotation is being displaced from the axis of rotation of the driving head in a direction transverse to the driving head axis of rotation by the displacement of said outer roll; said predetermined position of the outer roll being such as (i) to permit said progressive axial retraction and withdrawal of the open end of the can body wall from said cylindrical portion as the outer roll is displaced, (ii) to control the forming of the emerging end flange as said open end is displaced transversely across and in frictional contact with said end face, and (iii) to maintain a frictional driving connection between the can body and the driving head after the open end of the can body has withdrawn from said cylindrical portion, thereby to continue rotation of the can body during formation of said end flange.

2. A method according to claim 1, wherein the step (e) of stabilising the position of said can body comprises placing an inner roll inside the can body so as to make contact with the inner surface of the can body at a position which is (a) disposed axially adjacent the outer roll on the side thereof remote from the driving head, and (b) is displaced circumferentially, relative to said driving head axis of rotation, from the outer roll in the direction of rotation of the can body, at which position the inner roll exercises a position-stabilising action on the can body when the can body is displaced transversely from its central position on said end face of said driving head and moved across said end face by said outer roll.

3. A method according to claim 2, including the step of displacing the inner roll progressively further in said circumferential direction as the outer roll displaces the can body progressively across said end face, thereby to maintain the position-stabilising action of the inner roll on the can body.

4. A method according to claim 2, wherein said inner roll is carried eccentrically on a rotatable support shaft which is disposed coaxially with said driving head, and the position of the inner roll is changed by rotating said support shaft.

5. A method according to claim 2, wherein said outer roll is carried on a lever arm which is arranged for rotation about a fulcrum, and the position of the outer roll is changed by rotating said lever arm about its fulcrum.

6. A method of deforming an open end of of a cylindrical metal wall constituting a can body thereby to form therein an outwardly projecting end flange and adjacent thereto an inwardly projecting bead, which method includes the steps of:

(a) placing the can body co-axially adjacent a rotatable driving head with the open end of said wall engaged frictionally and drivingly on a cylindrical portion of the driving head, which portion has a transverse end face and which portion is encircled by an outer annular portion which defines with said cylindrical portion an annular groove in which said open end of said can body wall is confined against radially outwards displacement;

(b) placing inside the can body at a predetermined axial distance from the driving head a rotatable inner roll of pretermined diameter less than the desired internal diameter of the bead to be formed in the can body;

(c) bringing that inner roll into contact with the internal surface of the can body thereby to support that surface against displacement;

(d) placing a rotatable outer roll adjacent the outer surface of the can body at a predetermined position lying axially within the distance separating the driving head and the inner roll and radially adjacent the inner roll;

(e) rotating the driving head about an axis normal to said end face thereby to rotate the can body about its longitudinal axis; and (f) progressively urging the outer roll radially against the outer surface of the can body as it is rotated thereby to cause the progressive formation in the can body wall of a bead and a consequential progressive axial retraction of the open end of the can body wall in the annular groove;

said annular groove being of radial width such as to maintain the shape of the open end of the can body wall substantially in its original cylindrical form so long as it remains engaged in the groove, and said predetermined position of the outer roll being such as to permit said progressive axial retraction of the open end of the can body wall in the annular groove as the bead is formed.

7. A method according to claim 6, including the following additional steps:

(g) after formation of the bead, displacing the inner roll from its position in contact with the inner surface of the can body wall and radially adjacent the outer roll to another position displaced circumferentially, relative to said driving head axis of rotation, in the direction of rotation of the can body, in which position it exercises a position-stabilising action on the can body when it is subsequently displaced from its central position on said end face and moved across said end face by said outer roll; and (h) progressively urging the outer roll further against the outer surface of the can body wall as it is rotated thereby to withdraw the open end of the can body wall completely from said annular groove and then to progressively urge that open end across and in frictional contact with said transverse end face thereby to deform said open end into an outwardly-directed flange lying adjacent the bead;

said predetermined position of the outer roll being also such as (a) to control the forming of the emerging end flange, and (b) to maintain the frictional driving connection between the can body and the driving head after the open end of the can body has withdrawn from said cylindrical portion, thereby to continue rotation of the can body during formation of said end flange.

8. A method according to claim 7, including the step of displacing the inner roll progressively further in said circumferential direction as the outer roll displaces the can body progressively across said end face, thereby to maintain the position-stabilising action of the inner roll on the can body.

9. A method according to claim 6, wherein said inner roll is carried eccentrically on a rotatable support shaft which is disposed coaxially with said driving head, and each of said steps (c) and (g) is carried out by rotating said support shaft.

10. A method according to claim 6, wherein said outer roll is carried on a lever arm which is arranged for rotation about a fulcrum, and each of said steps (d), (f) and (h) is carried out by rotating said lever arm about its fulcrum.

11. A method according to claim 6, wherein said annular groove comprises a cylindrical groove.

12. Apparatus for deforming a cylindrical can body wall to provide at the open end thereof an outwardly directed end flange, which apparatus comprises:

(a) a rotatable driving head having concentrically thereon a cylindrical portion for receiving in frictional and driving engagement therewith a said open end of a cylindrical can body wall, said cylindrical portion having a transverse end face;

(b) driving means for rotating the driving head about an axis normal to said transverse end face thereby to rotate a can body engaged with the driving head about a longitudinal axis of the can body;

(c) a rotatable outer roll for engaging the external surface of said can body wall engaged with said driving head, thereby to be rotated by the can body wall;

(d) an outer roll carrier on which said outer roll is rotatably carried, said carrier being arranged for movement whereby to move said outer roll transversely towards said can body wall thereby to apply pressure to said external surface of said body wall at a predetermined position axially adjacent said end face;

(e) outer roll actuating means coupled to said outer roll carrier for effecting movement of said outer roll carrier thereby to urge said outer roll progressively into greater contact with said can body wall at said predetermined position, thereby to cause, on rotation of the driving head, the progressive axial retraction of the open end of the can body wall, and the eventual withdrawal thereof from the cylindrical portion thereby to deform said open end into an outwardly directed end flange; and (f) stabilising means for stabilising the position of the can body as it rotates about its own longitudinal axis whilst that axis of rotation is being displaced transversely from the axis of rotation of the driving head by displacement of the outer roll;

said predetermined position of the outer roll being such as (i) to permit said progressive axial retraction and withdrawal of the open end of the can body wall from said cylindrical portion as the outer roll is displaced, (ii) to control the forming of the emerging end flange as said open end is displaced transversely across and in frictional contact with said end face, and (iii) to maintain a frictional driving connection between the can body and the driving head after the open end of the can body has withdrawn from said cylindrical portion, thereby to continue rotation of the can body during formation of said end flange.

13. Apparatus according to claim 12, wherein said stabilising means comprises an inner roll placed inside said can body so as to make contact with the inner surface of the can body at a position which is (a) disposed axially adjacent the outer roll on the side thereof remote from the driving head, and (b) is displaced circumferentially, relative to said driving head axis of rotation, from the outer roll in the direction of rotation of the can body, at which position the inner roll exercises a position-stabilising action on the can body when the can body is displaced transversely from its central position on said end face of said driving head and moved across said end face by said outer roll.

14. Apparatus according to claim 13, including means for displacing the inner roll progressively further in said circumferential direction as the outer roll displaces the can body progressively across said end face, thereby to maintain the position-stabilising action of the inner roll on the can body.

15. Apparatus according to claim 13, wherein said inner roll is carried eccentrically on a rotatable support shaft which is disposed coaxially with said driving head, and the position of the inner roll is changed by rotating said support shaft.

16. Apparatus according to claim 13, wherein said outer roll is carried on a lever arm which is arranged for rotation about a fulcrum, and the position of the outer roll is changed by rotating said lever arm about its fulcrum.

17. Apparatus for deforming a cylindrical can body wall to provide at the open end thereof an outwardly directed end flange and adjacent thereto an inwardly directed bead, which apparatus includes for forming said bead:

(a) a rotatable driving head having concentrically thereon a cylindrical portion for receiving in frictional and driving engagement therewith a said open end of a cylindrical can body wall, said cylindrical portion having a transverse end face, and which portion is encircled by an outer annular portion which defines with said cylindrical portion an annular groove in which said open end of said can body wall is confined against radially outwards displacement;

(b) driving means for rotating the driving head about an axis normal to said transverse end face thereby to rotate a can body engaged with the driving head about a longitudinal axis of the can body;

(c) a rotatable inner roll for engaging the internal surface of a said can body engaged with said driving head, said inner roll having a predetermined outer diameter less than the desired internal diameter of the bead to be formed in the can body;

(d) an inner roll carrier on which said inner roll is rotatably carried, said carrier being arranged for movement to and from an operative position, in which position the inner roll contacts the internal surface of the can body engaged with said driving head, at a position spaced a predetermined axial distance from said driving head;

(e) a rotatable outer roll for engaging at a position radially adjacent said inner roll the external surface of said can body engaged with said driving head;

(f) an outer roll carrier on which said outer roll is rotatably carried, said carrier being arranged for movement whereby to move said outer roll transversely towards said can body wall thereby to apply pressure to said external surface of said can body at a predetermined position lying axially within said distance separating said driving head and said inner roll;

(g) inner roll actuating means coupled to said inner roll carrier for effecting movement of said inner roll carrier to and from said operative position;

(h) outer roll actuating means coupled to said outer roll carrier for effecting movement of said outer roll carrier thereby to urge said outer roll progressively into greater contact with said can body wall at said predetermined position, thereby to progressively form, on rotation of the driving head with said inner roll carrier in said operative position, an inwardly directed bead, said open end of said can body wall being retracted axially within but not withdrawn from said annular groove during the formation of the bead, and said groove being of a radial width such as to maintain the shape of the open end of the can body wall substantially in its original cylindrical form so long as it remains engaged in said annular groove.

18. Apparatus according to claim 17, including control means for co-ordinating operation of said inner roll actuating means and said outer roll actuating means in a manner such as to perform the following sequence of operations:

(a) to move said inner roll carrier to said operative position in which the inner roll contacts the internal surface of a can body engaged with the rotating driving head;

(b) to move said outer roll carrier in a direction to cause said outer roll to contact and press against said rotating can body wall thereby to form said bead;

(c) to retract said inner roll carrier; and (d) to retract said outer roll carrier.

19. Apparatus according to claim 18, wherein said control means is arranged to perform between steps (c) and (d) an additional step (e), which step comprises continuing temporarily the movement of the outer roll carrier thereby to urge the outer roll further against the outer surface of the rotating can body wall and thereby (i) to withdraw the open end of the can body wall completely from said annular groove and then (ii) to progressively urge that open end across and in frictional contact with said transverse end face of the rotating driving head so as to deform said open end into an outwardly directed flange lying adjacent the bead.

20. Apparatus according to claim 17, wherein said inner roll carrier comprises a rotatable carrier shaft disposed co-axially with said driving head, and said inner roll is mounted eccentrically on said rotatable carrier shaft.

21. Apparatus according to claim 20, wherein said rotatable carrier shaft is carried for rotation within said rotatable driving head, and said inner roll is eccentrically mounted at the free end of said carrier shaft.

22. Apparatus according to claim 17, wherein there is provided a drive shaft drivingly coupled with said driving head, and said control means includes first and second cams drivingly coupled with said drive shaft, and first and second cam followers associated with the respective cams and coupled with the respective inner and outer roll actuating means.

23. Apparatus according to claim 17, wherein said annular groove comprises a cylindrical groove.

* * * * *

UNITED STATES PATENT AND TRADEMARK OFFICE

CERTIFICATE OF CORRECTION

PATENT NO. : 5,076,087

DATED : December 31, 1991

INVENTOR(S) : David G. Slater

It is certified that error appears in the above-identified patent and that said Letters Patent is hereby corrected as shown below:

Column 15, line 38, change "98B" to -- 98D --.

Signed and Sealed this

Tenth Day of August, 1993

*Attest:*

Michael K. Kirk

MICHAEL K. KIRK

*Attesting Officer*

*Acting Commissioner of Patents and Trademarks*